US011408056B2

(12) United States Patent
Weiss et al.

(10) Patent No.: US 11,408,056 B2
(45) Date of Patent: Aug. 9, 2022

(54) ALUMINUM BASED ALLOY CONTAINING CERIUM AND GRAPHITE

(71) Applicant: Intelligent Composites, LLC, Milwaukee, WI (US)

(72) Inventors: David J. Weiss, Manitowoc, WI (US); Pradeep K. Rohatgi, Whitefish Bay, WI (US); Christopher T. Jordan, Okauchee, WI (US); Simon S. Beno, Milwaukee, WI (US); James H. Hunter, III, Elm Grove, WI (US); Benjamin F. Schultz, Milwaukee, WI (US)

(73) Assignee: Intelligent Composites, LLC, Milwaukee, WI (US)

( * ) Notice: Subject to any disclaimer, the term of this patent is extended or adjusted under 35 U.S.C. 154(b) by 944 days.

(21) Appl. No.: 16/056,993

(22) Filed: Aug. 7, 2018

(65) Prior Publication Data

US 2019/0040496 A1 Feb. 7, 2019

Related U.S. Application Data

(60) Provisional application No. 62/605,259, filed on Aug. 7, 2017.

(51) Int. Cl.

| | |
|---|---|
| ***C22C 1/10*** | (2006.01) |
| ***C22C 21/02*** | (2006.01) |
| ***C22C 1/02*** | (2006.01) |
| ***B22F 1/17*** | (2022.01) |
| *F02F 1/00* | (2006.01) |

(52) U.S. Cl.

CPC ..... *C22C 1/1068* (2013.01); *C22C 1/026* (2013.01); *C22C 1/101* (2013.01); *C22C 1/1036* (2013.01); *C22C 21/02* (2013.01); *B22F 1/17* (2022.01); *F02F 1/004* (2013.01); *F02F 2200/06* (2013.01); *F05C 2201/903* (2013.01)

(58) Field of Classification Search

None

See application file for complete search history.

(56) References Cited

U.S. PATENT DOCUMENTS

| | | | | |
|---|---|---|---|---|
| 4,297,976 | A * | 11/1981 | Bruni | C22C 21/02 123/193.2 |
| 5,626,692 | A * | 5/1997 | Rohatgi | C22C 1/1036 148/437 |
| 6,074,497 | A * | 6/2000 | Inoue | B22F 9/082 148/403 |
| 9,963,770 | B2 | 5/2018 | Rios et al. | |
| 2017/0362687 | A1 | 12/2017 | Rios et al. | |
| 2018/0080102 | A1 | 3/2018 | Rios et al. | |
| 2018/0080103 | A1 | 3/2018 | Plotkowski et al. | |

* cited by examiner

*Primary Examiner* — George Wyszomierski
*Assistant Examiner* — Janell C Morillo
(74) *Attorney, Agent, or Firm* — Boyle Fredrickson S.C.

(57) ABSTRACT

The present invention provides an aluminum hybrid metal matrix composite including cerium and graphite. The aluminum-cerium intermetallic is stable at temperatures up to a melting point of aluminum and graphite provides in situ lubrication. This stability is advantageous in applications such as cylinder liners and other applications where strength and stiffness at elevated temperatures are required.

20 Claims, 3 Drawing Sheets

ALUMINUM BASED ALLOY CONTAINING CERIUM AND GRAPHITE

CROSS-REFERENCE TO RELATED APPLICATIONS

The application claims the benefit of U.S. provisional application 62/605,259 filed Aug. 7, 2017, hereby incorporated by reference.

BACKGROUND OF THE INVENTION

Cylinder liners, also known as cylinder sleeves, for internal combustion engines are central to the engines' operating performance. A cylinder liner is a cylindrical part fitted into an engine to form an inner wall of the engine's cylinder block receiving a reciprocating piston with outer encircling piston rings. The cylinder liner forms a sliding surface for the piston rings while also retaining the proper amount of lubricant between the piston and cylinder liner. It is desired that the cylinder liners provide high anti-galling properties, low wear on the cylinder liner, low wear on the piston rings, and low consumption of lubricant.

Not only do the cylinder liners undergo high amounts of friction but the cylinder liners also receive high amounts of combustion heat from the piston and piston rings. It is desired that the heat effectively transfer from the piston, through the cylinder liners, to the outer cooling jackets. While undergoing high amounts of heat and pressure, the cylinder liners must seal with the piston rings to prevent the compressed gas and combustion gas from escaping the combustion chamber to the crank case.

Typically, cylinder liners are often made from cast iron which have excellent wear resistant properties but hinder the heat transfer from the combustion chamber into the cooling jackets.

Many lighter engines use cylinder liners made from aluminum alloys but have poor wear resistance properties and exhibit deformation. Currently, aluminum alloys are limited to applications below 230° Celsius due to the rapid loss of mechanical characteristics at higher temperatures. Generally, for operating temperatures above 250° Celsius additional elements are required for thermal stability. Therefore, aluminum cylinder liners often require additional coatings to prevent wear and failure caused by the piston ring abrasion.

SUMMARY OF THE INVENTION

It has been found that the addition of cerium in aluminum alloys improves the cast-ability of the alloy and maintains the mechanical characteristics of the alloy above 250° Celsius. Cerium modified aluminum alloys have been described in U.S. Pat. No. 9,963,770, to the present inventor, hereby incorporated by reference.

The present invention provides cylinder liners for internal combustion engines in which graphite is added to aluminum-cerium-silicon/silicon carbide composites to provide a high temperature wear resistant composite. The present inventors have determined that the presence of cerium and graphite within the alloy matrix changes the segregation pattern of the metals and reduces the size of eutectic solid particles since the solidification will occur in narrower spaces between the reinforcement particles.

The addition of graphite enhances the performance of the aluminum alloy by acting as an in-situ lubricant that, as the material wears, the alloy continues to expose new lubricant.

It is understood that while the present invention is described with respect to application with cylinder liners, the aluminum alloy matrix may also be used with other high temperature products that operate above 250° Celsius, including turbocharger components, cylinder heads, pistons, and the like.

Specifically, the present invention provides an aluminum alloy matrix having the following composition: between 6 and 16 weight percent cerium; between 1 and 20 volume percent graphite; and the remainder being aluminum alloy.

The graphite may be coated with a metal promoting wettability with aluminum. The graphite may be coated with nickel having between 30 and 70 weight percent nickel and a thickness of 1 to 5 microns of nickel.

The aluminum alloy may further comprise between 1 and 7 weight percent nickel.

The aluminum alloy may further comprise between 4 and 25 weight percent silicon.

The aluminum alloy may further comprise up to 25 weight percent carbide.

The aluminum alloy may further comprise between 0.3 and 10 weight percent magnesium.

The aluminum alloy may form an $Al_{11}Ce_3$ intermetallic.

Another embodiment of the present invention further provides method for manufacturing an aluminum cast alloy comprising: first, mixing between 4 and 25 weight percent silicon or up to 25 volume percent silicon carbide into a melted base of aluminum; second, mixing between 1 and 20 volume percent graphite into the melted base of aluminum; third, mixing between 6 and 16 weight percent cerium into the melted base of aluminum; pouring the melted base of aluminum into a mold; removing the aluminum composite from the mold; and removing an outer layer of the aluminum composite to expose the graphite.

The method may further include heating the aluminum composite from 900° to 1000° Fahrenheit; quenching the aluminum composite with water at between 100° and 200° Fahrenheit to harden the aluminum composite; and cooling the aluminum composite to approximately room temperature.

The method may further include heating the aluminum composite to between 300° and 700° Fahrenheit for 4 to 12 hours to precipitation harden the aluminum composite.

The method may further include mixing silicon into the melted base of aluminum prior to mixing silicon carbide into the melted base of aluminum.

The method may further include filtering the melted case of aluminum before pouring the melted base of aluminum into the mold to control the flow rate of the metaled base. The filter may have a pore size that is larger than particles present in the melt to allow the particles to pass through.

The mold may be a cylindrical mold to produce a cylinder. The cylinder liner may be inserted into an internal combustion engine.

Another embodiment of the present invention provides an aluminum cast alloy having the following composition: between 6 and 16 weight percent cerium; up to 25 volume percent silicon carbide; and the remainder being aluminum.

These particular features and advantages may apply to only some embodiments falling within the claims and thus do not define the scope of the invention.

DETAILED DESCRIPTION OF THE INVENTION

Figure 1:
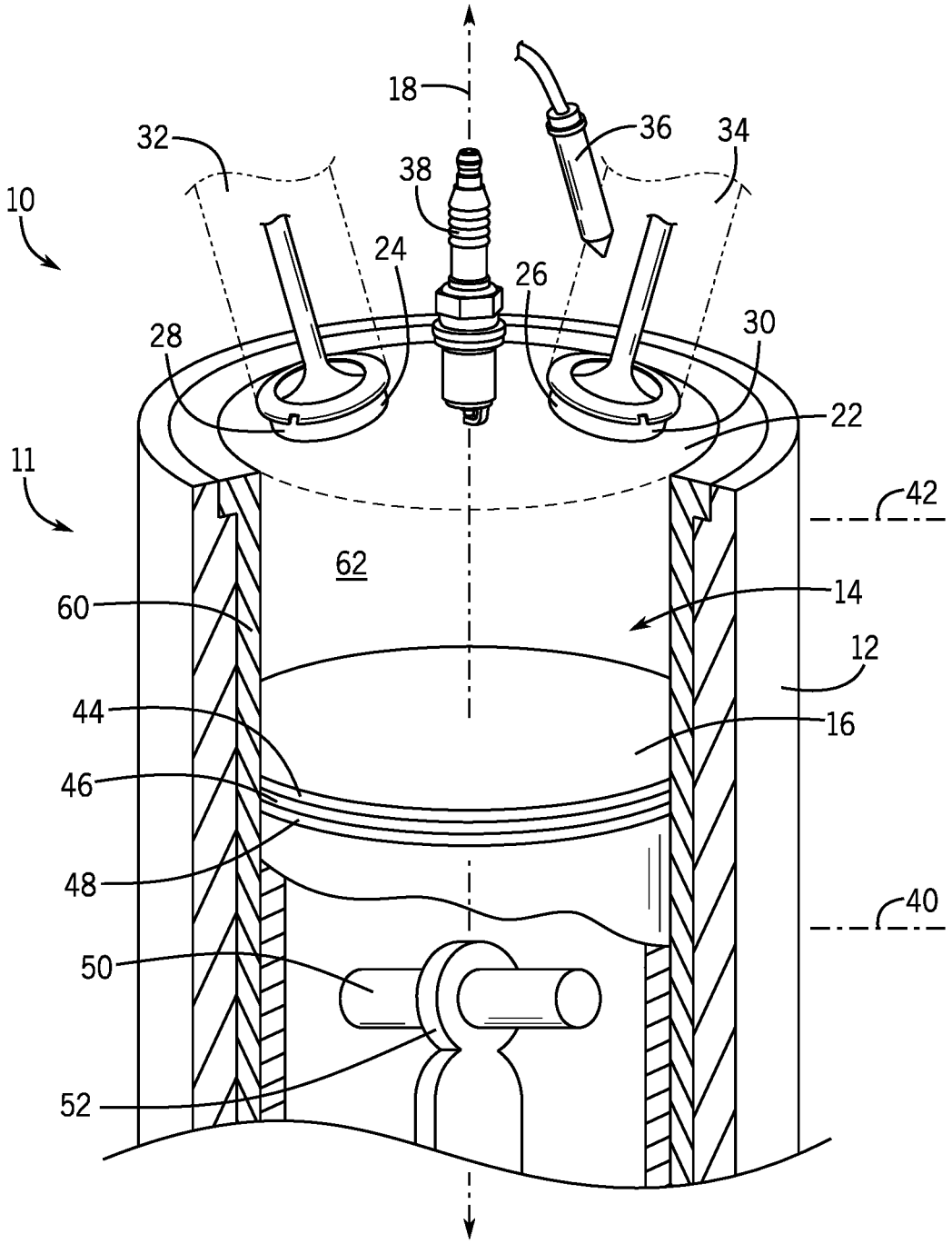
FIG. 1 is a cut-away side elevation view of a cylinder liner constructed according to the present invention as installed within a cylinder block of an internal combustion engine.

Referring now to FIG. 1, an internal combustion engine 10 for use with the present invention may provide for one or more combustion chambers 11 providing an outer cylinder block 12 having a cylindrical passageway 14 receiving a piston 16 having a generally cylindrical shape reciprocating along a longitudinal axis 18 of the cylinder block 12 and driven by a crankshaft (not shown).

The outer cylinder block 12 may be enclosed at a top end by a cylinder head 22 having valve openings 24 and 26 having corresponding valves 28 and 30. The valve 28 may control the exit of exhaust gases from the outer cylinder block 12 through exhaust manifold 32. The valve 30 may control the receipt of air to an intake manifold 34, intake manifold 34 including a fuel injector 36 of conventional design. Alternatively, it will be appreciated that the fuel injector 36 may be placed directly in the cylinder head 22 to inject directly into the outer cylinder block 12.

For gasoline engines, the cylinder head 22 may support a spark plug 38 having electrodes exposed within the outer cylinder block 12; however, the present invention is equally applicable to diesel engines where the spark plug 38 is not required.

The piston 16 may reciprocate along the longitudinal axis 18 within the cylindrical passageway 14 of the outer cylinder block 12 between a bottom position 40 and a top position 42 proximate the cylinder head 22. An upper edge of the piston 16 may include a set of rings including a top ring 44, a middle ring 46, and a lower ring 48 being a set of metal rings radially compressed to fit in corresponding slots of the piston 16 opening radially outward from the cylindrical piston wall. The rings 44, 46, 48 expand outward to form a tight seal between the piston 16 and an inner wall of the cylindrical passageway 14 defined by a cylinder liner 60 to be further described below. The lower ring 48 may be an oil ring providing a proper quantity of oil between the piston 16 and the cylinder liner 60.

A lower end of the piston 16 may include a wrist pin 50 attaching the piston 16 to a connecting rod 52, the connecting rod 52 attached to a crankshaft (not shown). The wrist pin 50 allows the piston 16 to pivot with respect to the connecting rod 52 while accommodating the eccentric movement of a crankshaft attachment and allowing the piston 16 to move in a substantially straight line up and down along longitudinal axis 18.

The outside of the outer cylinder block 12 may be surrounded by a cylindrical coolant chamber (not shown). The coolant chamber may carry water or other coolant circulated by a circulation pump removing the heated water from the outer cylinder block 12 and replacing the heated water with chilled water.

The inner wall of the outer cylinder block 12 may be lined by a cylinder liner 60 having a cylindrical cross-section and extending within the cylindrical passageway 14 to receive the reciprocating piston 16 sliding closely along an inner surface 62 of the cylinder liner 60.

Referring now to FIGS. 2 to 5, the cylindrical liner 60 may be formed of a tubular shape of cast alloy material formed by a mixing and casting process described below.

The alloy material has the following composition:

Aluminum (Al) alloy with the addition of:

Silicon (Si)—about 4 and 25 weight percent (wt %) or about 4 and 18 wt %; and/or Silicon carbide (SiC)—up to 25 volume percent (vol %); and Graphite (G or Gr)—about 1 and 20 vol %, or about 2 and 5 vol %; and Nickle (Ni)—about 1 and 7 wt %; and Cerium (Ce)—about 6 and 16 wt %; and Magnesium (Mg) (optional)—about 0.3 and 10 wt %.

Figure 4:
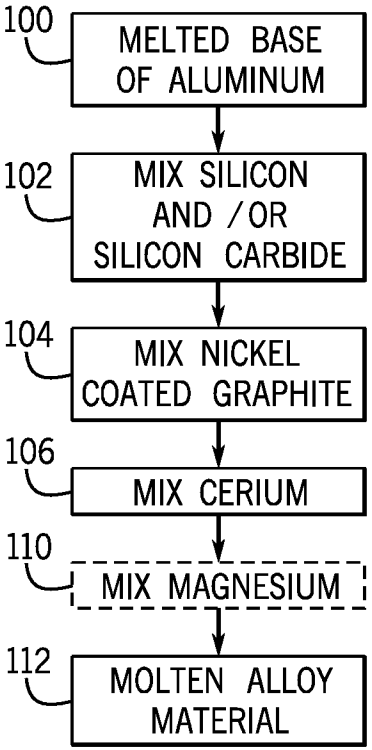
FIG. 4 is a process flow chart showing the process of mixing the metallic and non-metallic alloying elements into the melted aluminum.

Referring to the method steps of FIG. 4, the cast alloy material may be formed by initially starting with a melted base of aluminum metal that is at least 99% pure, as indicated by process block 100. The aluminum metal is heated to 100° Celsius or about 100° Celsius above its melting temperature under an oxygen-excluded atmosphere.

To the aluminum alloy, 98% pure silicon is added using either an aluminum-silicon master alloy or silicon metal, as indicated by process block 102. The silicon is added with a stirring device connected to an impeller rotating at 280-700 RPM. The length of time required for the mixing is dependent on the batch size.

Silicon may be added to the aluminum base at a weight percentage between 4 and 25% or about 4 and 18%. Silicon carbide may be added to the aluminum base at a volume percent up to 25%. When both silicon and silicon carbide are added, the silicon is added before the silicon carbide at a 7 to 9% weight percentage. The addition of silicon carbide before the silicon may lead to the formation of aluminum carbides which renders the alloy prone to corrosion and reduces the mechanical qualities of the alloy.

It has been found that the addition of the silicon and/or silicon carbide generally provides heightened wear resistance and higher effective operating temperature of aluminum alloys.

Next, after the silicon and/or silicon carbide is fully melted, graphite is added by continuous coating of the graphite with nickel to produce nickel coated graphite and then stirring the nickel coated graphite into the melt, as indicated by process block 104. The graphite may be crystalline small flakes or flake graphite having isolated, flat, plate-like particles with hexagonal edges if unbroken and irregular or angular edges when broken. The length of the graphite flakes may be about 10 to 200 microns or approximately 100 microns. The graphite may alternatively be fragmentary or round particles with a similar length of about 10 to 200 microns such as in a powder form. The graphite may be added to the aluminum base at a volume percent between 1 and 20% or between 2 and 5%.

The nickel content of the nickel coated graphite may on the order of 30 to 70 wt % of the nickel coated graphite and may have a thickness of 1 to 5 microns. The nickel coating may be at a weight percent between 1 and 7% after the dissolution of nickel coating from the graphite. The nickel coated graphite is added with a stirring device connected to an impeller rotating at 280-700 RPM. Feeding rate of the prepared graphite powder is between 1 pound per minute and 10 pounds per minute.

The addition of nickel improves the wetting and homogenous distribution of the graphite. Once mixed, the nickel coating dissolves allowing for the introduction of cerium which forms an intermetallic with aluminum as described below. Alternatively, nickel may be replaced with other metals which promote the wettability with aluminum, such as copper.

Next, after the graphite is fully incorporated into the melt, cerium may be added to the melted base of aluminum, as indicated by process block 106. The cerium may be added to the aluminum base at a weight percent between 6 and 16%. The cerium is added in the form of metallic cerium with a weight of between 1 and 4 pounds at the rate of one to 10 pounds per minute. The large ingots and oxygen-excluded atmosphere help reduce the likelihood of the cerium causing a fire or oxidizing because of its reactivity. The metallic cerium is dissolved in the alloy with a stirring device connected to an impeller rotating at 70-100 RPM. The melt temperature should be controlled to between 750° and 775° Celsius, at least 750° Celsius is required to dissolve the Ce in the alloy and temperatures over 775° Celsius may catalyze undesirable phases including aluminum carbide.

Aluminum and cerium form an intermetallic compound inside the alloy as it melts. The rapid formation of intermetallics directly from the liquid phase during solidification of Al—Ce alloys leads to an ultrafine microconstituent structure that effectively strengthens the casted alloy without further microstructural optimization via thermal processing.

Figure 2:
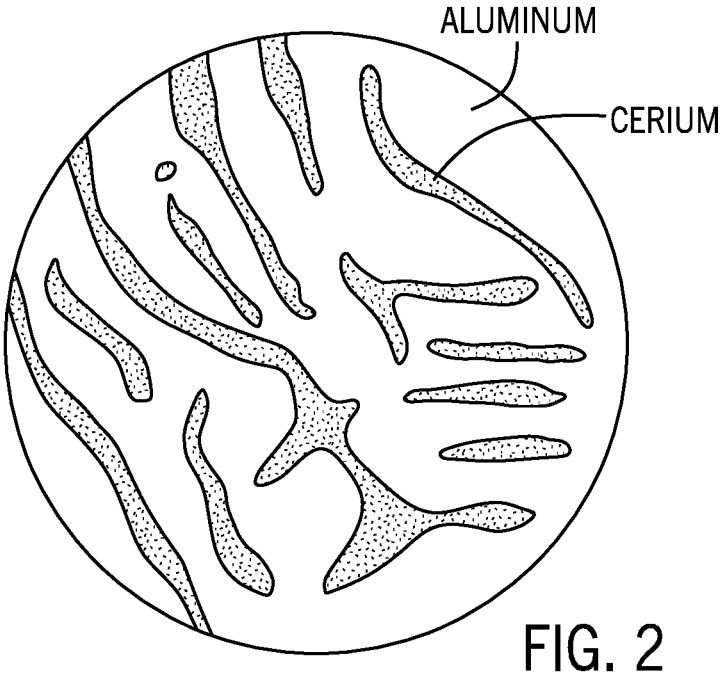
FIG. 2 is a representative diagram of the microstructure of a cylinder block containing aluminum and cerium ($Al_{11}Ce_3$)

An $Al_{11}Ce_3$ intermetallic phase is formed having a microstructure that includes at least one of lath features and rod morphological features. The morphological features have an average thickness of no more than 700 um and an average spacing of no more than 10 um, the microstructure further comprises a eutectic microconstituent that comprises more than about 10 volume percent of the microstructure. The microstructure of aluminum-cerium alloy ($Al_{11}Ce_3$) is shown in FIG. 2.

Figure 3:
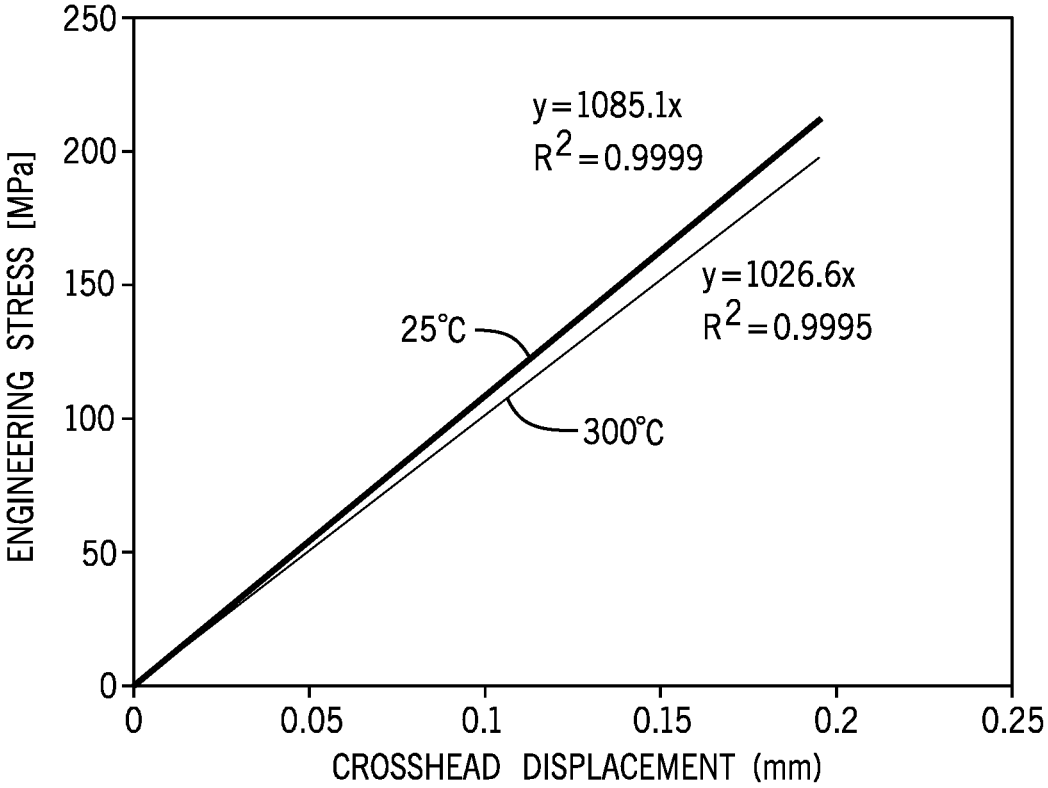
FIG. 3 is a line graph showing the relatively small change in bulk modulus for alloys containing cerium between 25° Celsius and 300° Celsius.

The $Al_{11}Ce_3$ intermetallic has a high melting point, above 1093° Celsius (2000° Fahrenheit), making the alloy matrix stable at 300° Celsius (572° Fahrenheit), a temperature that would cause traditional aluminum alloys to lose a significant percentage of their properties. As seen in FIG. 3, aluminum-cerium alloy shows only minor changes to bulk modulus from 25° Celsius up to 300° Celsius. Therefore, the addition of metallic cerium to the cast alloy material improves the high temperature performance of the cast alloy material 70.

Under certain conditions, e.g., a cooling rate of 3° to 10° Celsius per second, the silicon carbide and graphite particles present in the melt act as nucleation sites for aluminum-cerium phases which precipitate from the melt and further refine the microstructure.

Next, optionally, after the cerium is fully melted, magnesium may be added to the melted base of aluminum after the addition of cerium, as indicated by process block 110. The magnesium may be added to the aluminum base at a weight percent between 0.3 and 10%. The metallic magnesium is dissolved in the alloy with a stirring device connected to an impeller rotating at 70-100 RPM.

The cerium reduces the tendency of the melt to dissolve hydrogen from combustion products or from the atmosphere. Therefore, the magnesium should be added after the cerium is added to reduce hydrogen pick-up. The magnesium combines with silicon to provide a heat treatment response.

It is understood that the order of the alloying or mixing of metals and non-metals may be determined by the desired composition of the alloy material.

Figure 5:
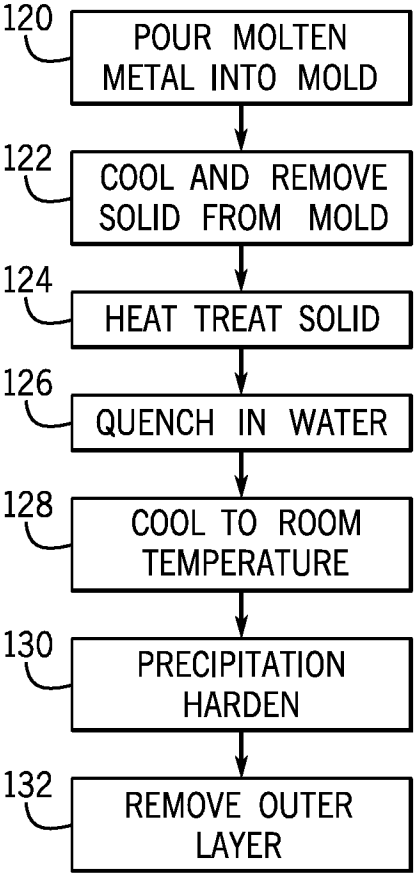
FIG. 5 is a process flow chart showing the formation of cast aluminum alloy of the present invention by alloying aluminum with cerium and graphite particles to produce a homogenous alloy matrix.

Referring to the method steps of FIG. 5, the molten alloy material is poured into a mold formed into a pattern or into a die cavity using either gravity or pressure, as indicated by process block 120.

Casting without defects is accomplished through velocity control of the molten metal stream, most commonly by using a filter to control the molten metal flow rate which decreases the metal velocity to a computationally determined level but of a pore size that prevents filtering of any of the alloying elements or reinforcement particles. In addition to velocity control using a filter, engineering design of the filling system is possible to reduce the molten metal velocity. In both cases, molten metal velocity is controlled to a maximum velocity of 0.5 meters/second to eliminate defects.

The molten alloy material is then allowed to solidify by cooling, for example, to room temperature, and then removed from the mold as indicated by process block 122.

The hardened article is then solution heat treated to the desired mechanical properties using a solution process that depends upon the amount of magnesium alloy but general consists of a temperature starting at about 900° Fahrenheit and is increased in 20 degree increments every 2 hours until a final temperature of about 1000° Fahrenheit is reached where it is held for about 12 hours, as indicated by process block 124.

The hardened article is then quenched in water at a temperature of between 100° and 200° Fahrenheit, as indicated by process block 126.

The hardened article is then cooled at room temperature for at least 24 hours, as indicated by process block 128.

The articles are precipitation hardened, or strengthened by heating, by heating to between 300° and 700° Fahrenheit for 4 to 12 hours, as indicated by process block 130.

It is understood that alternative heat treatments including homogenization may be appropriate based on the alloy chemistry. For alloys containing high levels of magnesium, heat treatment may not be required because of the solid solution strengthening effect of magnesium.

After the casting is complete, the resultant cast alloy material may have a graphite depleted outer surface and a homogenous inner matrix. The depleted outer surface may include some of the alloyed elements but may not include graphite or silicon carbide; the homogenous inner matrix may include all of the alloyed elements. The hardened outer surface of the cast alloy material is removed (1 mm or less) by machine to expose the homogenous inner matrix insuring that the graphite is exposed, as indicated by process block 132.

The addition of graphite or another dry lubricant in situ provides heightened lubrication supplementing standard engine lubrication. Graphite has a layered structure of hexagonal planes of polycyclic carbon atoms with the distance between carbon atoms being longer so that bonding between layers is weak. Such layers are able to slide relative to each other with minimal applied force, thus giving them their low friction properties. Graphite offers lubrication at higher temperatures (up to 450° Celsius) compared to liquid and oil-based lubricants. As the cast alloy material wears, more graphite is exposed to provide new lubricant to the outside of the cylindrical liner 60.

The improved high temperature properties of aluminum-silicon/silicon carbide-graphite-cerium particle composites provide high performance cylinder liners where operating temperature exceed 250° Celsius.

In another embodiment of the present invention, the cast aluminum alloy may be manufactured for other high temperature applications (above 250° Celsius) that are not cylinder liners, for example, turbocharger components, cylinder heads, pistons, and the like. In this respect, the addition of silicon or silicon carbide is optional. In a similar manner as described above, each metal is mechanically mixed into the melted base of aluminum for a suitable time to distribute the alloying elements homogenously into the base aluminum. The molten material is then poured into a mold formed into a pattern for its intended application.

TABLE 1

Surface Deformation Temperatures

| Aluminum Alloy | Temperature at which the surface deforms by yielding under typical loads |
|---|---|
| 10S4G - 10 vol % SiC, 4 vol % Gr | 425° C. |
| 10S4G8Ce - 10 vol % SiC, 4 vol % Gr, 8% wt % Ce | 450° C. |

Table 1 illustrates that the presence of both graphite (G or Gr) and cerium (Ce) in the aluminum alloy ($10S_4G_8Ce$) compared to aluminum alloy without cerium ($10S_4G$) has higher disruption temperatures.

TABLE 2

Mechanical Properties

| | Tensile (Mpa) | Yield | Elongation (%) |
|---|---|---|---|
| Room Temp: | | | |
| 10S4G- 10 vol % SiC, 4 vol % Gr | 275 | 260 | 0.55 |
| 10S4G8Ce - 10 vol % SiC, 4 vol % Gr, 8 wt % Ce | 227 | 186 | 1 |
| At 300° C: | | | |
| 10S4G- 10 vol % SiC, 4 vol % Gr | 110 | 74 | 1.1 |
| 10S4G8Ce - 10 vol % SiC, 4 vol % Gr, 8 wt % Ce | 176 | 99 | 1.1 |

Table 2 illustrates that the presence of both graphite (G or Gr) and cerium (Ce) in the aluminum alloy ($10S_4G_8Ce$) compared to aluminum alloy without cerium ($10S_4G$) has improved mechanical properties at elevated temperatures (at 300° C.). The improvement is not seen at lower temperatures (room temperature—about 23° C.).

It has been found that the addition of graphite and cerium has the largest impact on mechanical properties. For example, the standard material containing 20% vol SiC but without graphite or cerium has maximum tensole properties at 300° Celsius of 83 MPa tensile, 76 MPa yield and 5.5% elongation.

"Alloying elements" refer to both metals and non-metals, such as graphite, that are added to the aluminum base.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications are hereby incorporated herein by reference in their entireties.

We claim:

1. A cast aluminum alloy suitable for conventional casting, comprising:

an aluminum matrix;

between 6 and 16 weight percent cerium distributed within the aluminum matrix; and a reinforcement phase of between 1 and 20 volume percent graphite particles distributed within the aluminum matrix, wherein said graphite particles have a thickness that is between 10 and 200 microns;

wherein the aluminum and cerium form an intermetallic compound with a crystal structure, said intermetallic compound having an average thickness that is in the magnitude of hundreds of microns and an average spacing in the magnitude of microns.

2. The cast aluminum alloy of claim 1 wherein the graphite particles are coated with a metal promoting wettability with aluminum.

3. The cast aluminum alloy of claim 2 wherein the graphite particles are coated with nickel, the graphite particles coated with nickel having between 30 and 70 weight percent nickel.

4. The cast aluminum alloy of claim 1 wherein the aluminum alloy further comprises between 1 and 7 weight percent nickel.

5. The cast aluminum alloy of claim 1 wherein the aluminum alloy further comprises between 4 and 25 weight percent silicon.

6. The cast aluminum alloy of claim 1 wherein the aluminum alloy further comprises up to 25 volume percent silicon carbide.

7. The cast aluminum alloy of claim 1 wherein the aluminum alloy further comprises between 0.3 and 10 weight percent magnesium.

8. A cast aluminum alloy suitable for conventional casting, comprising:

an aluminum matrix;

between 6 and 16 weight percent cerium within the aluminum matrix;

up to 25 volume percent silicon carbide within the aluminum matrix; and a reinforcement phase of between 1 and 20 volume percent graphite particles within the aluminum matrix, wherein said graphite particles have a thickness that is between 10 and 200 microns;

wherein the aluminum and cerium form an $Al_{11}Ce_3$ intermetallic compound, said $Al_{11}Ce_3$ intermetallic compound having an average thickness that is in the magnitude of hundreds of microns and an average spacing in the order of microns; and wherein the aluminum alloy is a substantially homogenous mixture of graphite particles within the aluminum matrix.

9. The cast aluminum alloy of claim 1 wherein the graphite particles are up to 200 microns in overall size.

10. The cast aluminum alloy of claim 1 wherein the aluminum alloy has a stable bulk modulus at up to 300 degrees Celsius.

11. A method for manufacturing a cast aluminum alloy suitable for conventional casting, the method comprising:

preparing a melted aluminum matrix by first, mixing between 4 and 25 weight percent silicon or up to 25 volume percent silicon carbide into a melted base of aluminum;

second, mixing a reinforcement phase of between 1 and 20 volume percent graphite particles into the melted base of aluminum, wherein said graphite particles have a thickness that is between 10 and 200 microns;

third, mixing between 6 and 16 weight percent cerium into the melted base of aluminum;

pouring the melted aluminum matrix into a mold;

cooling the melted aluminum matrix to solidify the aluminum matrix within the mold; and removing the solidified aluminum matrix from the mold;

wherein the aluminum and cerium form an intermetallic compound with a crystal structure, said intermetallic compound having an average thickness that is in the magnitude of hundreds of microns and an average spacing in the magnitude of microns.

12. The method of claim 11 wherein the graphite particles are coated with a metal promoting wettability with aluminum.

13. The method of claim 12 wherein the graphite particles are coated with nickel, the graphite particles coated with nickel having between 30 and 70 weight percent nickel.

14. The method of claim 11 further comprising the steps of:

heating the aluminum matrix between 900° to 1000° Fahrenheit;

quenching the aluminum matrix with water at between 100° and 200° Fahrenheit to harden the aluminum matrix; and cooling the aluminum matrix to approximately room temperature.

15. The method of claim 14 further comprising the step of:

heating the aluminum matrix to between 300° and 700° Fahrenheit for 4 to 12 hours to precipitation harden the aluminum matrix.

16. The method of claim 9 further comprising the step of:

mixing silicon into the melted base of aluminum prior to mixing silicon carbide into the melted base of aluminum.

17. The method of claim 11 further comprising the step of filtering the melted base of aluminum before pouring the melted base of aluminum into the mold to control the flow rate of the melted base.

18. The method of claim 17 wherein the filter has a pore size that is greater than particles present in the melt.

19. The method of claim 11 wherein the mold is a cylindrical mold shaped to form a cylinder liner.

20. The method of claim 19 wherein the cylinder liner is inserted into an internal combustion engine.

* * * * *